US005649751A

United States Patent [19]

Longhurst

[11] Patent Number: 5,649,751

[45] Date of Patent: Jul. 22, 1997

[54] STRUCTURAL MEMBER SUPPORTED STORAGE UNIT

[76] Inventor: Robert E. Longhurst, RFD Box 351 Potterbrook Farm, Chestertown, N.Y. 12817

[21] Appl. No.: 560,481

[22] Filed: Nov. 17, 1995

[51] Int. Cl.[6] ..... A47B 67/02

[52] U.S. Cl. ..... 312/242; 312/245; 312/351.14; 248/318; 248/201

[58] Field of Search ..... 248/200.1, 201, 248/214, 318, 320; 312/242, 245, 270.1, 270.2, 351.14, 351.6; 52/27

[56] References Cited

U.S. PATENT DOCUMENTS

| | | | |
|---|---|---|---|
| 3,331,645 | 7/1967 | Vercellotti | 312/248 |
| 4,446,660 | 5/1984 | Miller et al. | 52/36 |
| 4,699,437 | 10/1987 | Genereaux | 312/248 |
| 5,011,239 | 4/1991 | Guerin | 312/248 |
| 5,039,902 | 8/1991 | Schwarz | 312/245 |
| 5,242,219 | 9/1993 | Toraaka | 312/245 |
| 5,407,261 | 4/1995 | Mercer | 312/248 |
| 5,460,280 | 10/1995 | Feddeler | 211/116 |

OTHER PUBLICATIONS

Leichtung Catalog; F/W 1995; p. 6; "Between Joist Storage Unit".

*Primary Examiner*—Peter M. Cuomo
*Assistant Examiner*—Stephen Vu
*Attorney, Agent, or Firm*—Fredric T. Morelle

[57] ABSTRACT

A structural member-supported storage box. An open-top case projects at least two rod-engaging hooks so as to effect a constrainable pendulous or cantilevered fixation. Rods engagable by the hooks are fixed as orthogonal transversals to a pair of adjacent ceiling joists, wall studs or similar beams. The hooks of the invention, by engagement of the rods, cause the box to be nested between the paired joists, studs or beams. The books are movably fixed to the box in a number of arrangements to be complemented by the rod emplacement.

6 Claims, 3 Drawing Sheets

STRUCTURAL MEMBER SUPPORTED STORAGE UNIT

BACKGROUND OF THE INVENTION

1. Field of Invention

This invention relates to storage units and specifically to units that are supported by exposed roof rafters, exposed wall studs or overhead exposed structural joists of a building such as found in a basement, garage, attic or outdoor tool shed.

2. Discussion of Relevant Art

It has been suggested by several disclosures that the volume of space between structural joists be used for storage purposes. Many activities associated with home businesses, hobbies and home and garden maintenance exist in basements, garages or outdoor tool sheds where exposed overhead joists and exposed wall studs are present and where storage units would prove useful and practical.

The structural member storage device in U.S. Pat. No. 4,446,660 issued to Miller et al., May 8, 1984, which is constructed of cardboard, would have a limited life and weight capacity. Since this unit operates like a drawer, the amount of containment and support space required would be twice the length of the storage unit. Space would be wasted and accessing could be difficult if a short step stool were required to reach and withdraw the unit.

The apparatus for storing objects in U.S. Pat. No. 4,699,437 issued to Genereaux, Oct. 13, 1987, is supported by very precise roller and bearing mechanisms and only allows for slight variations in how joists are spaced. In reality, the spaces involved can vary substantially. Joists can be bowed along their length, warped or cupped across their width and can vary in thickness and height. Placement can also vary. Discrepencies in placement were more pronounced prior to the use of plywood subflooring. Installation and alignment of the supporting rollers and bearings for this disclosure would be difficult in many situations, unless material were added to joists or removed to yield a precise width. This unit would not have application to pre-engineered wood joists which can only be loaded from their top flange, since there would not be clearance for the supporting roller and bearing mechanisms.

The overhead storage system in U.S. Pat. No. 5,039,902 issued to Schwarz, Aug. 13, 1991, is supported by vertically fastening screws into the subfloor between joist members. Application of fasteners in this manner could result in damage to the finished floor above. Applying loads to fasteners in their direction of withdrawal would be a limiting factor, especially since only a short length of screw engagement into the subfloor would be achieved.

The between rafters storage device in U.S. Pat. No. 5,242,219 issued to Tomaka, Sep. 7, 1993, operates like a drawer and therefore requires a space twice the length of the storage unit. This, like U.S. Pat. No. 4,446,660 issued to Miller et al., would be a waste of space and accessing could be difficult if a short step stool were required to reach and withdraw the unit. This unit ('219), which is also secured into the bottom of structural joists, would not have application to pre-engineered wood joists which can only be loaded from their top flange.

One aspect that all of the earlier approaches have in common is that they are all oriented towards permanent or semi-permanent storage. The space between joists has been catagorized as wasted space and I believe this, in effect has dictated storage units for unwanted, marginal or seasonal items only. Such storage units do not respond to nor do they have the flexibility to respond to the activities that would be associated within a garage, basement, outdoor tool shed or any other space with exposed structural members.

INCORPORATION BY REFERENCE

Because they disclose common and state-of-the-art design and or mechanisms, U.S. Pat. Nos. 4,446,660, 4,699,437, 5,039,902 and 5,242,219 are herein incorporated by reference.

DETAILED DESCRIPTION OF THE PREFERRED EMBODIMENT

Figure 1:
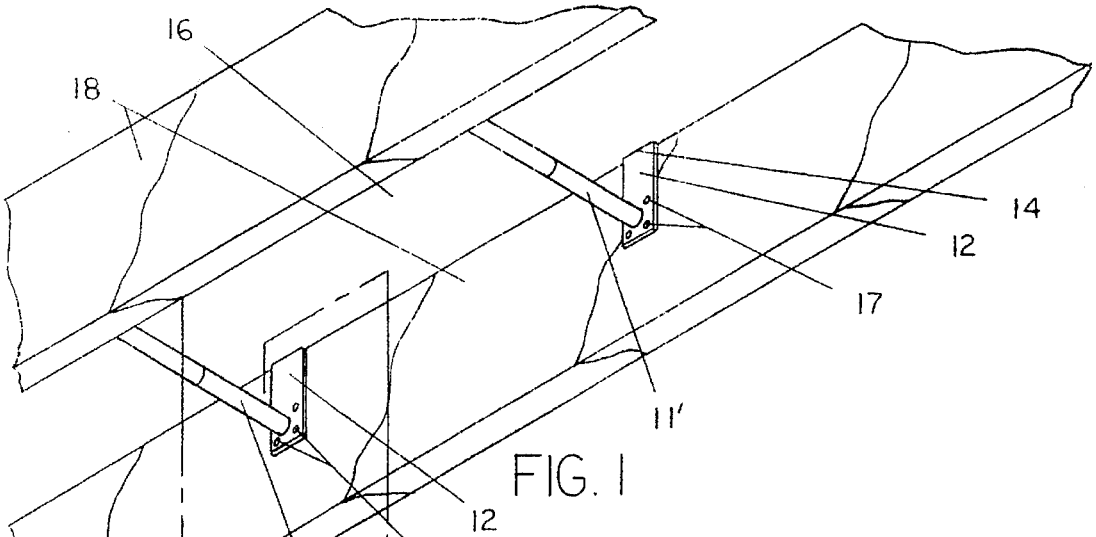
FIG. 1 shows exposed floor joists with two transversal telescoping rods.
Figure 2:
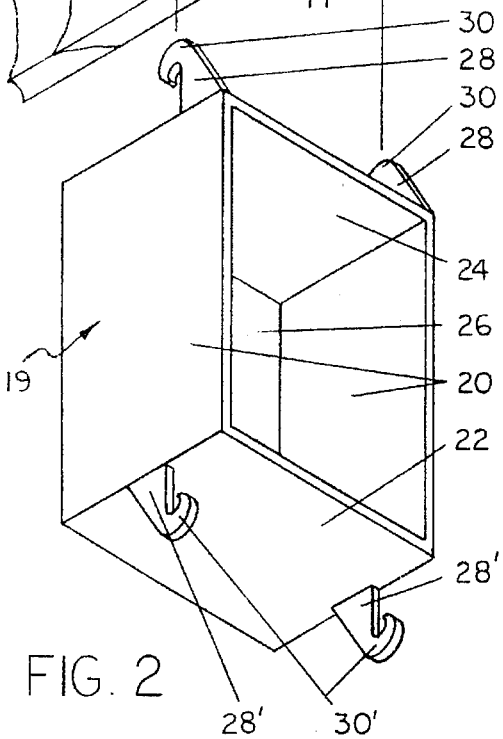
FIG. 2 shows a storage container with two pairs of hooks.

FIG. 1 and 2 shows the preferred embodiment of a storage unit that is supported by overhead exposed floor joists. Two elongated, transversal telescoping rods 11/11' span the perpendicular distance between structural supports. A flange 12 is attached to the ends of each telescoping rod 11/11'. Flanges 12 have a top edge 14 that abuts with subfloor 16. Flanges 12 are secured to joists 18 with conventional fasteners 17, e.g., screws.

An open case or container 19 is formed of side panels 20, a front panel 22, a back panel 24 and a bottom 26. Back struts 28, integral or removably attached, extend from the ends of each side panel 20. A hook 30 is located at the end of each back strut 28. Similarly, front struts 28' extend from the opposite ends of each side panel 20. A hook 30' is located at the end of each front strut 28'.

The combination of telescoping rods 11/11' and flanges 12 enable a telescoping rod to be installed perpendicular to the inside vertical faces of two adjacent exposed joists 18. Edges 14 of flanges 12 automatically locate the elevation of a telescoping rod, so that measuring is not required. The two telescoping rods are spaced apart at a predetermined distance relative to hook placement.

To install a storage container or case 19, such is lifted vertically with hooks 30 at top, towards the respective back telescoping rod 11. Hooks 30 are moved up and over to engage the telescoping rod. At this point, the storage container 19 is hanging pendulously in a substantially vertically position. This vertical position is the open or load/unload position.

Figure 3:
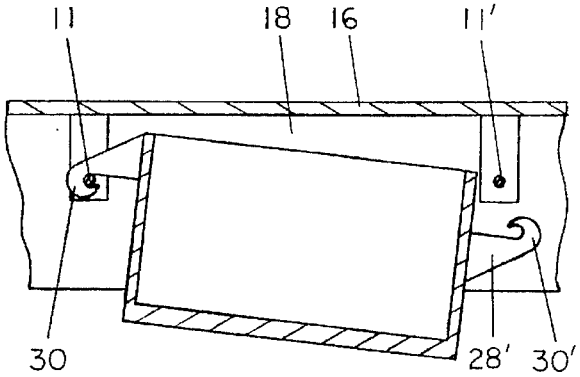
FIGS. 3 and 4 shows sections through the storage container and relationships of hooks to transversal telescoping rods during operation within floor joist space.
Figure 4:
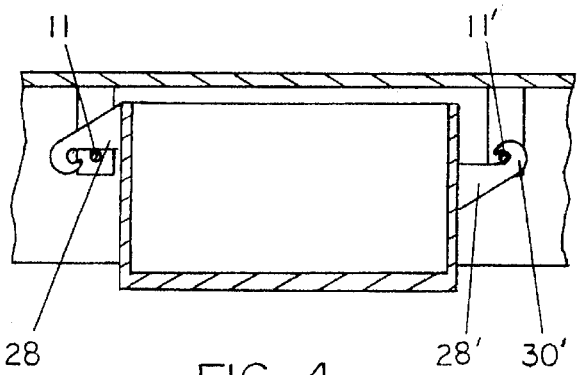

FIG. 3 illustrates the storage container moving into the closed position. The container is manually pivoted upwards between joists 18 towards subfloor 16. When front strut 28' makes contact with telescoping rod 11', container 19 is moved back and away from user, so that back struts 28 slide on telescoping rod 11, until front hooks 30' make engagement with telescoping rod 11'. (See FIG. 4.) At this point the storage unit is embraced at both ends, is substantially horizontal and in the closed position.

Figure 5:
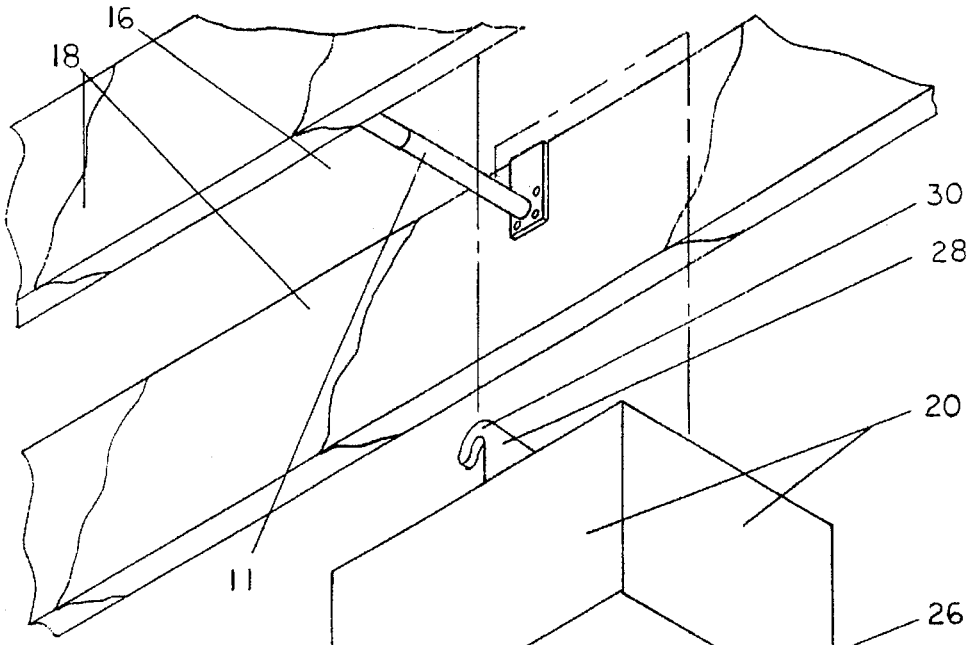
FIG. 5 shows floor joist space with one transversal telescoping rod.
Figure 6:
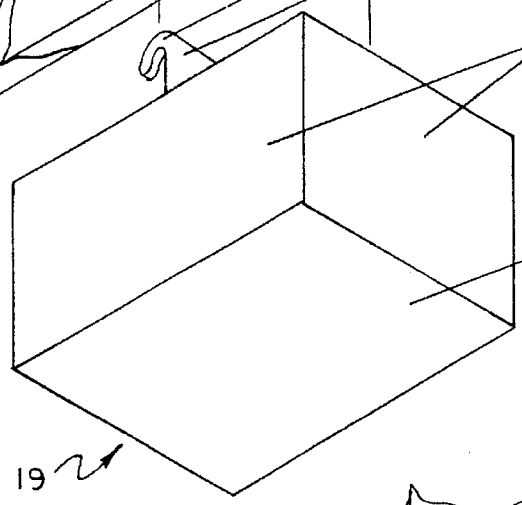
FIG. 6 shows a basic storage container with one pair of hooks.

FIG. 5 and 6 relates to the invention in an alternate embodiment, utilizing a single pair of hooks 30 attached to an open case 19. A strut 28 extends upwards from each of two opposite side panels 20. A hook 30 extends from each strut 28 and is located at approximately the center of each of the two side panels 20, the nominal center of gravity for the case 19. To operate this embodiment, the storage container, with hooks 30 at top, is lifted up between exposed joists 18 towards subfloor 16, and over to make engagement with telescoping rod 11. At this point, the storage container is fully embraced in the stored, closed position.

Figure 8:
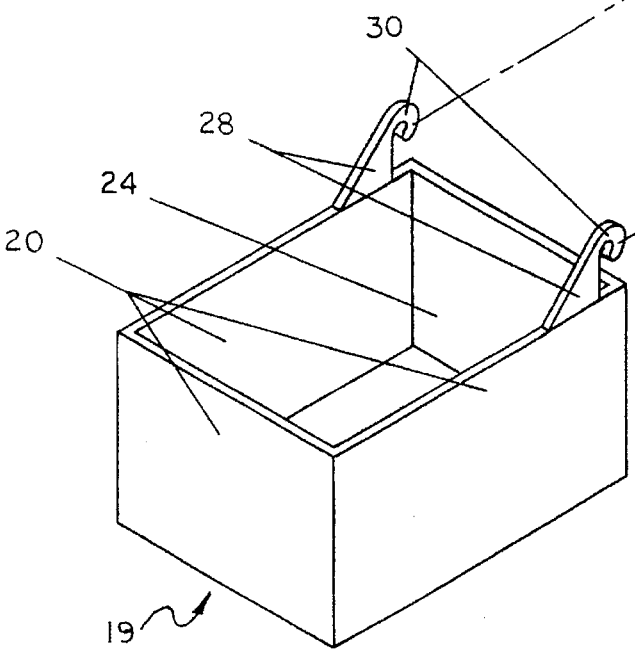
FIG. 8 shows a basic storage container with one pair of hooks.
Figure 7:
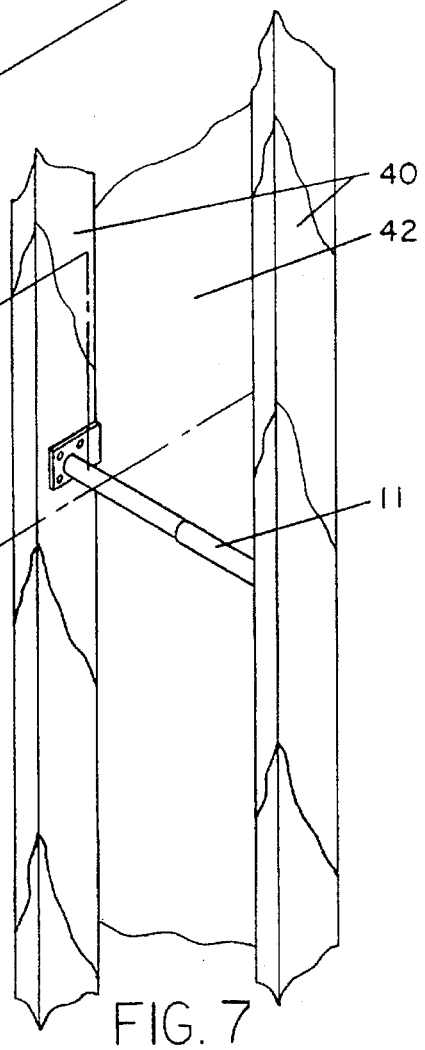
FIG. 7 shows a transversal telescoping rod within vertical wall studs.

Yet another alternate embodiment option, to that of FIG. 1 and 2, is shown in FIG. 7 and 8 which is a modification to allow wall stud support. FIG. 7 and 8 illustrate a container 19 of the invention with three side panels 20, and one back panel 24. A strut 28 extends upwards from each of two opposite side panels 20. A hook 30 extends from each strut 28 and is oriented towards the back of the case 19. To install, container is moved horizontally so that hooks 30 make engagement with telescoping rod 11 at the same time back panel 24 makes contact and bears against wall sheathing 42, so that the container is maintained in a horizontal and stable manner.

Figure 9:
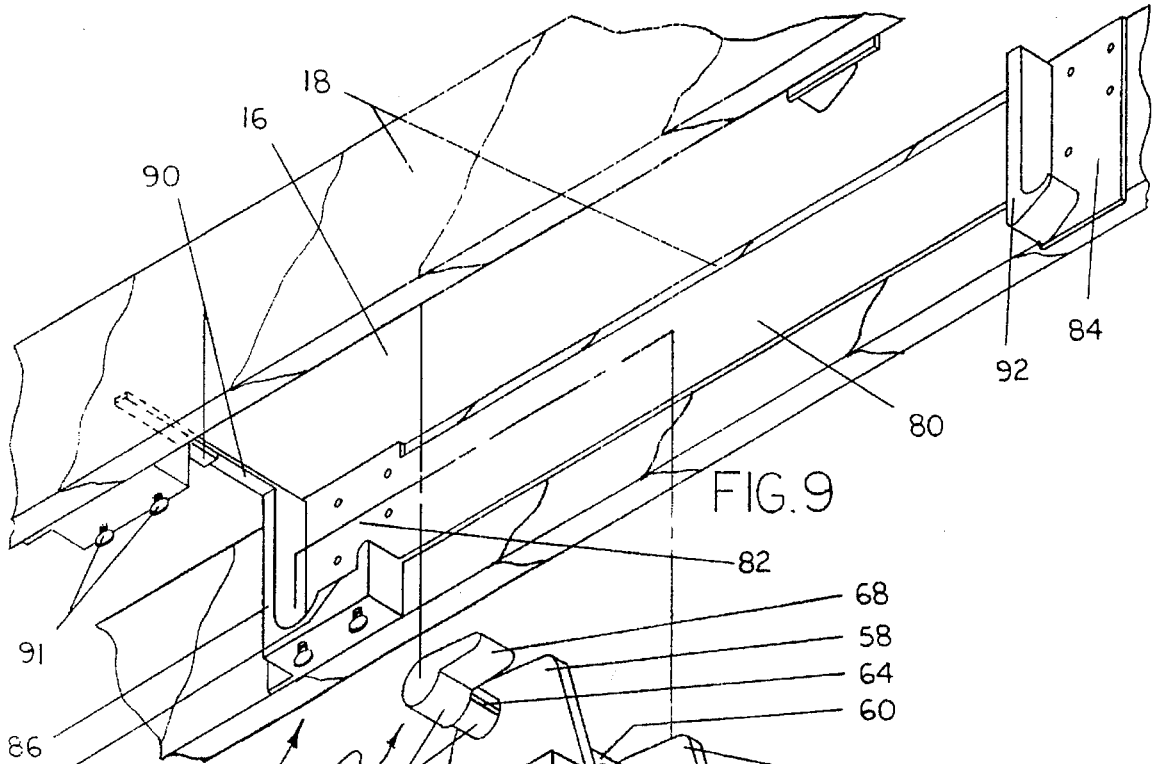
FIG. 9 shows receptor hooks within exposed floor joist space.
Figure 10:
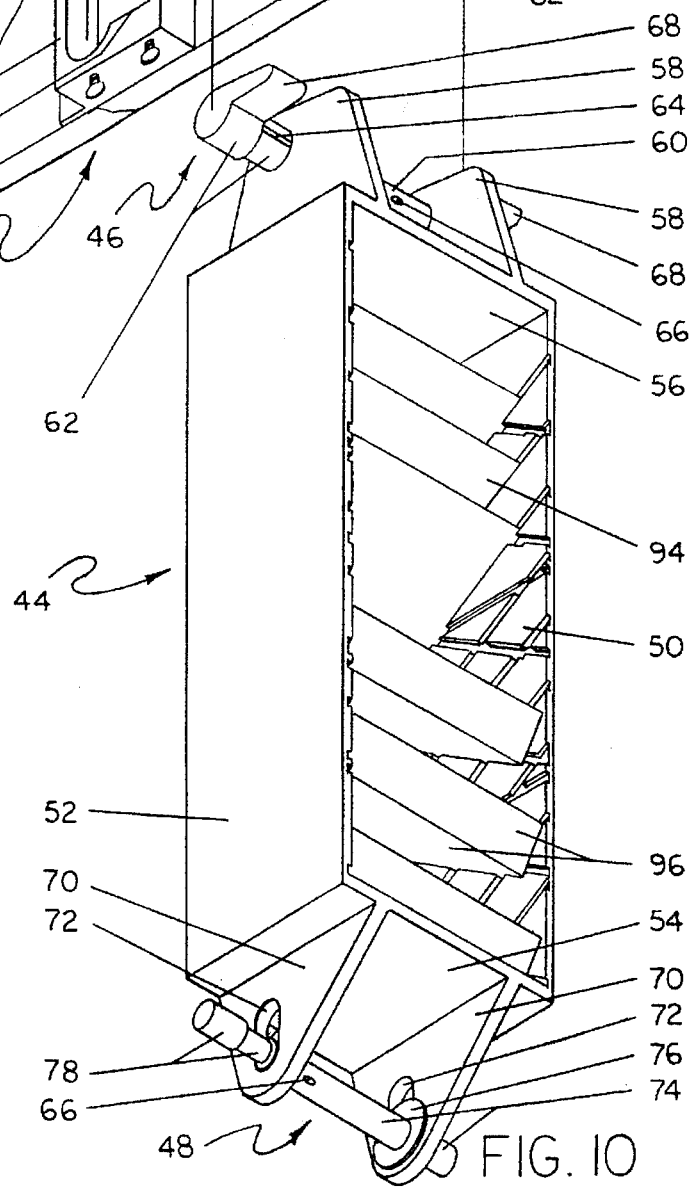
FIG. 10 shows storage unit with transversal telescoping rods at front and back of unit.

Another alternative embodiment of a storage unit to that shown in FIG. 1–4 is illustrated in FIG. 9 and 10. The storage unit consists of right and left hand hook receptors 45, a container 44 with telescoping, pivotable projector 46 at one end and a telescoping, slidable fixable projector 48 at the other end.

The container 44 consists of side panels 50 and 52, a front panel 54, a back panel 56 and a bottom that is not shown. Back struts 58 are connected to back panel 56. A sleeve 60 extends through and is held in place by back struts 58. A telescoping rod 62 slides within sleeve 60. A groove 64 is located along the length of telescoping rod 62. A conventional fastener 66, e.g., set screw, extends through sleeve 60 and into groove 64. A stop 68 is attached to and projects from the end of telescoping rod 62, and a stop 68 is attached to the fixed projecting portion of sleeve 60.

Front struts 70 are connected to front panel 54. Within front struts 70 there are located elongated holes 72. A slidable fixable projector 48 is located within these elongated holes 72 and is comprised of a sliding sleeve 74 and a telescoping rod 78. Sliding sleeve 74 is held in place from lateral movement by two retainers 76, which are fastened to sliding sleeve 74. A telescoping rod 78 slides within sliding sleeve 74. A conventional fastener 66, e.g., set screw extends through sliding sleeve 74 and bears against telescoping rod 78.

FIG. 9 shows a right hand hook receptor 45 in an installed relationship with joists 18 and subfloor 16. A connecting rail 80 connects back plate 82 with a front plate 84. A hook 86 and a hook extension 88 is attached to back plate 82. A squaring tab 90 is attached to the top of hook 86 and projects outwards and overlaps the corresponding squaring tab 90 of the left hand hook receptor. A hook 92 is attached to front plate 84.

Right and left hand hook receptors 45 are secured to the inside faces of two adjacent joists 18. Conventional set screws 66 secure telescoping rods 62 and 78 to sleeve 60 and sliding sleeve 74 respectively to obtain the length that corresponds to the space between joists 18. To install storage container one lifts storage container vertically up and over so that ends of telescoping rod 62 and sleeve 60 as well as stops 68 come to rest on hooks 86 and hook extensions 88. Optional thumbscrews 91 can allow for minor adjustments to bring container 44 into a precisely plumb position.

To bring storage container from the vertical, open position to the closed position, one grasps slidably fixable projector 48 and manually rotates the storage unit upwards towards the joists above. When ends of slidably fixable projector 48 are above hooks 92, projector 48 is moved forward, away from user, to make engagement with hooks 92.

FIG. 10 shows a combination of possible dividers for the interior of the storage container. Corresponding parallel grooves are formed into the side panels 50 and 52 to accept dividers. Appropriately stored items for dividers 94, that are angled downward from top to bottom, may include files, magazines and catalogs. File markers would be easily read and files easily accessed if an individual were in a standing position. Appropriately stored items for trays 96, that are angled upward from top to bottom, may include hand tools and small parts. These items would be easily viewed and accessed if an individual were in a standing position. Appropriately stored items for dividers that are parallel from top to bottom may include stored items that would be substantially unaffected by the inherent rotation.

While my above description contains many specifics these should not be construed as limitations on the scope of the invention, but rather as varied exemplifications of the preferred embodiment. Many more variations are possible. For example, the main elements in the embodiment illustrated in FIG. 9 and 10 may be interchanged with elements of the embodiment shown in FIG. 1 and 2. All embodiments may include a cover. The container illustrated in FIG. 2 may include a handle to facilitate movement between the open and closed position. The containers shown in FIG. 2 and 10 are replacable by a conventional sheet of pegboard in which tools or other items would be hung by appropriate fasteners. The concept shown in FIG. 7 and 8 is applicable to a simple shelf, where one edge bears against wall sheathing 42. Concepts shown in FIG. 1 and 2, 5 and 6, and 9 and 10 are placable lower between supporting members in order to avoid plumbing or electrical wires. The embodiment shown in FIG. 5 and 6 is easily applied to diagonal roof rafters that are commonly found in garages, attics, and storage sheds. The hooks 30 of this concept may be continuous from one side to another to form a handle. All concepts shown are adaptive to finished surfaces that have adequate structural backing.

Thus the scope of the invention should be determined by the appended claims and their legal equivalents, rather than by the examples given.

What is claimed is:

1. A storage unit having a bottom, two sides and two ends for pivotal movement and securement into and out of a nested position between two essentially parallel structural members comprising:

a first embracement means having a means portion projecting from a first end of said unit which is effective for pivotal mating with a complementary portion of said first embracement means; said complementary portion of said first embracement means including a rod having a length spanning at least the width of said unit, and said portion of said first embracement means being a pair of hook members; and a second embracement means having a part a projecting from a second end of said unit, being effective for embracement with a complementary part of said second embracement means, said complementary part of said second embracement means including a rod having a length spanning at least the width of said unit, and said part of said second embracement means being a pair of hook members.

2. An open-top storage container fitted with two hook-rod assemblies and effective for mounting, pivotally moving and securing in nested storage between two parallel structural members comprising:

a box having a bottom surrounded by four panels;

a first hook-rod assembly defined by a first hook pair and a first rod having a length spanning at least the width of said box and pivotally engagable with said first hook pair, a portion of said first hook-rod assembly disposed on the box proximate a first panel thereof and the complement to said portion of said first hook-rod assembly disposed on and between the parallel structural members; and a second hook-rod assembly defined by a second hook pair and a second rod having a length spanning at least the width of said box and fixedly engagable with said second hook pair, a part of said second hook-rod assembly disposed on the box proximate a second panel thereof that is opposite said first panel and a complement to said part of said second hook-rod assembly disposed on and between the parallel structural members and set apart from said complement to said portion of said first hook-rod assembly, whereby said first hook-rod assembly is effective for engagingly mounting and pivotally moving the box in said nested storage between the two parallel structural and said second hook-rod assembly is effective for securing the box in said nested storage structural members between the two parallel structural members.

3. The container of claim 2 wherein at least one of said first rod and said second rod is a telescoping device.

4. The storage unit of claim 1 wherein at least one of the rods is a telescoping device.

5. A storage unit having a bottom, two sides and two ends for pivotal movement and securement into and out of a nested position between two essentially parallel structural members comprising:

a first embracement means having a portion projecting from a first end of said unit which is effective for pivotal mating with a complementary portion of said first embracement means, said portion of said first embracement means including a rod having a length spanning at least the width of said unit, and said complementary portion of said first embracement means being a pair of hook members; and a second embracement means having a part projecting from a second end of said unit, being effective for embracement with a complementary part of said second embracement means, said part of said second embracement means including a rod having a length spanning at least the width of said unit, and said complementary part of said second embracement means being a pair of hook members.

6. The storage unit of claim 5 wherein at least one of the rods is a telescoping device.

* * * * *